US008528911B2

(12) United States Patent
Oh et al.

(10) Patent No.: US 8,528,911 B2
(45) Date of Patent: Sep. 10, 2013

(54) EMPTY SHELL RECOVERY DEVICE

(75) Inventors: In Gyu Oh, Incheon (KR); Byoung Jin Lee, Incheon (KR); Hyeok Jun Oh, Incheon (KR); Han Na Oh, Incheon (KR); Sang Duk Kim, Seoul (KR)

(73) Assignees: In Gyu Oh, Incheon (KR); Byoung Jin Lee, Incheon (KR); Hyeok Jun Oh, Incheon (KR)

( * ) Notice: Subject to any disclaimer, the term of this patent is extended or adjusted under 35 U.S.C. 154(b) by 262 days.

(21) Appl. No.: 13/130,655

(22) PCT Filed: Dec. 23, 2009

(86) PCT No.: PCT/KR2009/007708

§ 371 (c)(1), (2), (4) Date: May 23, 2011

(87) PCT Pub. No.: WO2010/074499

PCT Pub. Date: Jul. 1, 2010

(65) Prior Publication Data

US 2011/0233870 A1 Sep. 29, 2011

(30) Foreign Application Priority Data

Dec. 24, 2008 (KR) ..... 10-2008-0133386
Feb. 16, 2009 (KR) ..... 10-2009-0012469

(51) Int. Cl.
*F41J 13/00* (2009.01)
*F41J 13/02* (2009.01)

(52) U.S. Cl.
USPC ..... 273/410; 273/404

(58) Field of Classification Search
USPC ..... 273/403–410
See application file for complete search history.

(56) References Cited

U.S. PATENT DOCUMENTS 941,642 A * 11/1909 Maxim ..... 273/410
3,519,272 A * 7/1970 De Vogelaere ..... 273/404
3,720,411 A * 3/1973 DeVogelaere ..... 273/404

(Continued)

FOREIGN PATENT DOCUMENTS

JP 63-179493 U 11/1988
JP 08-136194 A 5/1996
JP 2006-097932 A 4/2006
JP 2006-336986 A 12/2006

OTHER PUBLICATIONS

International Search Report, Appln No. PCT/KR2009/007708, dated Aug. 13, 2010.

*Primary Examiner* — Mark Graham
(74) *Attorney, Agent, or Firm* — Novick, Kim & Lee, PLLC; Jae Youn Kim

(57) ABSTRACT

The present invention relates to a device for collecting empty shells that have been used at a shooting range and specifically to an empty shell recovery device of low operating cost. To achieve the above, the empty shell recovery device according to an embodiment of the present invention is furnished with absorption panels that are isolated from each other and inserted into sliding grooves of side plates facing each other to enable replacement and absorb the kinetic energy of an empty shell, an empty shell collection part that is inserted into the rear of the side plate and furnished with an escape prevention panel that prevents empty shells from escaping, and an empty shell discharge part that collects empty shells falling from the empty shell collection part downward and discharges them. Thus empty shells used at a shooting range are collected and recycling of empty shells is made possible.

14 Claims, 6 Drawing Sheets

(56) References Cited

U.S. PATENT DOCUMENTS

| | | | | | |
|---|---|---|---|---|---|
| 4,445,693 | A * | 5/1984 | Angwin | 273/404 |
| 4,458,901 | A * | 7/1984 | Wojcinski | 273/410 |
| 4,819,946 | A * | 4/1989 | Kahler | 273/404 |
| 5,040,802 | A * | 8/1991 | Wojcinski et al. | 273/410 |
| 5,564,712 | A * | 10/1996 | Werner | 273/410 |
| 5,988,647 | A * | 11/1999 | Porter et al. | 273/410 |
| 6,543,778 | B2 * | 4/2003 | Baker | 273/407 |
| 6,722,195 | B2 * | 4/2004 | Duke | 73/167 |
| 8,313,103 | B2 * | 11/2012 | O'Neal et al. | 273/410 |
| 2009/0096173 | A1 * | 4/2009 | Bateman et al. | 273/410 |
| 2010/0327531 | A1 * | 12/2010 | Bavaro et al. | 273/410 |
| 2011/0062667 | A1 * | 3/2011 | Medina et al. | 273/404 |

* cited by examiner

EMPTY SHELL RECOVERY DEVICE

TECHNICAL FIELD

The present invention relates to a device that effectively collects empty shells that have been used at a shooting range, and more particularly to an empty shell recovery device with low operating cost.

BACKGROUND ART

Each shell fired from small arms, such as rifles, toward a target at a shooting range includes an empty cartridge, gunpowder and an empty shell. The empty cartridges are collected so as to confirm the number of shells which have been used. On the other hand, the empty shells are not collected since the empty shells come into contact with the target and are then split into pieces, which are scattered, or lodged in sand placed at the rear of the target. As a result, a recovery rate of the empty shells is very low. Consequently, the empty shells are not recycled.

Also, the empty shells buried under the ground are corroded by rain or water with the result that heavy metal components, such as lead and copper, constituting the empty shells pollute soil around the empty shells.

In particular, a predetermined number of shells are periodically used by the military. However, there has not been provided a collection device that is capable of satisfactorily recovering empty shells. Therefore, there is a need to develop an inexpensive empty shell recovery device that is capable of easily collecting empty shells with low operating cost.

DISCLOSURE

Technical Problem

Therefore, the present invention has been made in view of the above problems, and it is an object of the present invention to provide an empty shell recovery device that is capable of absorbing kinetic energy of empty shells and that is capable of collecting and discharging the empty shells. Also, it is another object of the present invention to provide an empty shell recovery device that is capable of adjusting force to absorb the kinetic energy based on the distance to a target and the kind of shells.

Also, it is another object of the present invention to provide an empty shell recovery device in which only components damaged during use can be minimally replaced to minimize operating cost.

Also, it is another object of the present invention to provide an inexpensive empty shell recovery device that is capable of effectively reducing kinetic energy of empty shells.

Also, it is another object of the present invention to provide an empty shell recovery device that is capable of preventing empty shells from escaping so that the empty shells are not lost.

Also, it is another object of the present invention to provide an empty shell recovery device to which a target paper can be detachably coupled.

Also, it is another object of the present invention to provide an empty shell recovery device that is capable of enabling the positions of empty shells having pierced the target paper to be accurately confirmed.

Also, it is another object of the present invention to provide an empty shell recovery device that is capable of collecting empty shells and discharging the collected empty shells.

Also, it is a further object of the present invention to provide an empty shell recovery device that is capable of effectively recovering empty shells even during zero-in shooting using a shell (5.56 mm).

Technical Solution

In accordance with an aspect of the present invention, the above and other objects can be accomplished by the provision of an empty shell recovery device including an empty shell collection unit including absorption panels that are isolated from each other and inserted into sliding grooves formed at opposite side plates facing each other to absorb kinetic energy of empty shells, the absorption panels being replaceable, and an escape prevention panel that is inserted into the sliding grooves located at the rear parts of the side plates to prevent empty shells from escaping, and an empty shell discharge unit to collect and discharge empty shells falling downward from the empty shell collection unit.

Also, the absorption panels may include a plurality of elastic unit panels stacked in the sliding grooves.

Also, the absorption panels may include a rubber plate, a compressed wool plate or a rubber pad plate filled with sand or compressed wool.

Also, the escape prevention panel may be made of Fibertex.

Also, a rolled target paper may be coupled to the upper part of the rear of the empty shell collection unit, and the target paper may be drawn so that the lower end of the target paper is temporarily fixed to the empty shell discharge unit via the front of the empty shell collection unit.

Also, the target paper may be spaced apart from the outside of the foremost one of the absorption panels.

Also, the empty shell discharge unit may include a hopper disposed below the empty shell collection unit and an empty shell receipt box disposed below an outlet port of the hopper.

Advantageous Effects

In the empty shell recovery device with the above-stated construction according to the present invention, it is possible to collect empty shells that have been used at a shooting range so that the empty shells can be recycled, thereby making a profit and, at the same time, preventing environmental pollution due to the empty shells.

Also, the kind, thickness and arrangement order of the absorption panels can be changed based on the kind of shells and the shooting distance. Consequently, it is possible to optically set the absorption panels without waste of the absorption panels based on shooting conditions, thereby reducing operating cost.

Also, in a case in which the absorption panels include elastic unit panels which are stacked, the elastic unit panel located at the middle part of each of the absorption panels, in which an impact group is formed, can be replaced by the elastic unit panel located at the upper or lower part of each of the absorption panels. Consequently, it is possible to minimally replace elastic unit panels damaged while shots are fired, thereby further reducing operating cost.

Also, in a case in which the absorption panels are made of rubber, it is possible to easily manufacture the absorption panels using existing rubber chips which are recycled at low manufacturing cost, thereby further reducing operating cost.

In addition, the target paper can be easily fixed to the empty shell recovery device using mount holders and a magnet, and therefore, it is possible for a user to rapidly replace the target paper.

Also, the target paper is spaced apart from the outside of the foremost one of the absorption panels. When an empty shell pierces the foremost one of the absorption panels, therefore, the target paper is prevented from being damaged due to abrupt deformation of the foremost one of the absorption panels. Consequently, it is possible to accurately confirm positions of an impact group after shots are fired.

In addition, the hopper and the empty shell receipt box are provided. Consequently, it is possible to easily collect and discharge empty shells falling downward from the empty shell collection unit.

DESCRIPTION OF DRAWINGS

The above and other objects, features and other advantages of the present invention will be more clearly understood from the following detailed description taken in conjunction with the accompanying drawings, in which.

BEST MODE

Now, the function, construction and operation of an empty shell recovery device according to the present invention will be described in detail with reference to exemplary embodiments illustrated in the accompanying drawings.

Hereinafter, the same reference numbers will be used throughout the drawings to refer to the same or like parts.

Figure 1:
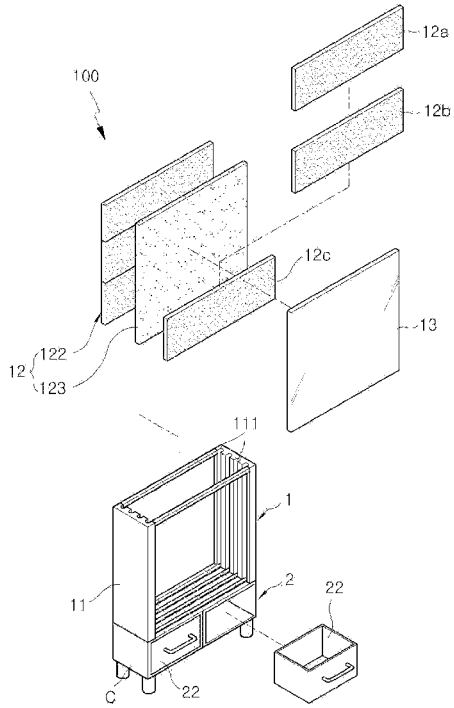
FIG. 1 is a schematic exploded perspective view illustrating an empty shell recovery device according to a first embodiment of the present invention.
Figure 2:
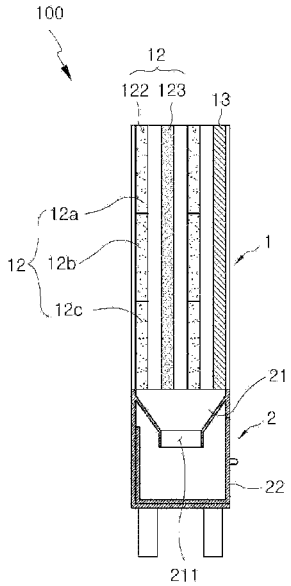
FIG. 2 is a schematic side sectional view illustrating an assembled state of the empty shell recovery device shown in FIG. 1.

FIG. 1 is a schematic exploded perspective view illustrating an empty shell recovery device according to a first embodiment of the present invention, and FIG. 2 is a schematic side sectional view illustrating an assembled state of the empty shell recovery device shown in FIG. 1.

The empty shell recovery device 100 according to the first exemplary embodiment of the present invention includes an empty shell collection unit 1 to absorb kinetic energy of empty shells and an empty shell discharge unit 2 to collect and discharge empty shells falling downward from the empty shell collection unit 1.

The empty shell collection unit 1 includes absorption panels 12 that are isolated from each other and inserted into sliding grooves 111 formed at opposite side plates 11 facing each other to absorb kinetic energy of empty shells in the flight direction thereof and an escape prevention panel 13 that is inserted into the rear parts of the side plates 11 to prevent the empty shells from escaping.

The side plates 11 are erected so as to face each other at edges of opposite sides of a main body C which stands on the ground. Also, the sliding grooves 111 are formed at opposite faces of the side plates 11 in a symmetrical fashion so that the sliding grooves 111 extend in the vertical direction.

The absorption panels 12 are inserted into the sliding grooves 111 from the front which a shell fired from a gun approaches. That is, the absorption panels 12 are inserted into the corresponding sliding grooves 111 in order to constitute a block layer through which empty shells pass.

Also, the sliding grooves 111 are formed so that neighboring sliding grooves 111 are spaced a predetermined distance from each other. Consequently, the absorption panels inserted into the sliding grooves 111 are isolated from each other.

The absorption panels 12 are made of a material that is capable of absorbing kinetic energy of an empty shell when the empty shell pierces the absorption panels 12. For example, metal plates may be stacked or a synthetic resin may be filled between the metal plates to constitute the absorption panels 12.

The absorption panels 12 may include a rubber plate 122 exhibiting high elasticity to lower operating cost. In this case, kinetic energy of an empty shell is absorbed by the rubber plate 122 when the empty shell pierces the rubber plate 122. At this time, vibration from the rubber plate 122, which is abruptly elastically deformed as the empty shell pierces the rubber plate 122, is not transmitted to one of the absorption panels 12 neighboring the rubber plate 122 since the neighboring one of the absorption panels 12 is spaced apart from the rubber plate 122. Consequently, the empty shell, having pierced the rubber plate 122, sequentially elastically deforms one of the absorption panels 12 following the rubber plate 122 with the result that kinetic energy of the empty shell is decreased. Also, the rubber plate 122 may contain netting thread so that the rubber plate 122 can be more durable.

On the other hand, the absorption panels 12 may include a compressed wool plate 123. For example, the compressed wool plate 123 may be configured by compressing cotton into the shape of a plate. The texture of the compressed wool plate 123 is very dense to effectively absorb rotational energy of an empty shell. In addition, impact applied to the empty shell from the compressed wool plate 123 is not great, and therefore, the compressed wool plate 123 prevents the empty shell from being destroyed and split. Also, the compressed wool plate 123 restrains rotational force of the empty shell since the compressed wool plate 123 has dense texture, and therefore, the compressed wool plate 123 has a function to lower penetrating force of the empty shell piercing the next one of the absorption panels 12.

When the empty shell pierces the compressed wool plate 123, the wool may be decompressed due to impact. For this reason, thin rubber pads may be attached to the front and rear of the compressed wool plate 123. In this case, the rubber pads attached to the front and rear of the compressed wool plate 123 prevent the wool from being decompressed as the empty shell pierces the compressed wool plate 123, thereby preventing the density of the wool from being lowered.

Figure 6:
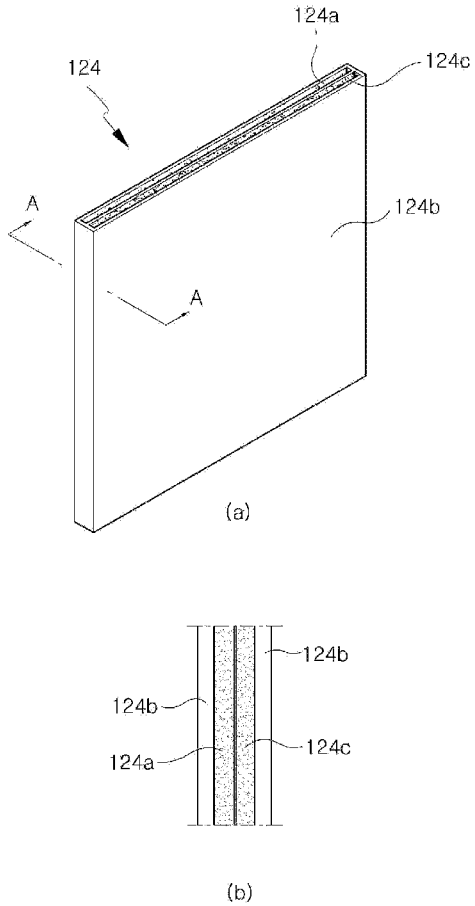
FIG. 6 is a schematic view illustrating a rubber panel shown in FIG. 5, wherein FIG. 6(*a*) is a partial perspective view of the rubber panel and FIG. 6(*b*) is a sectional view taken along line A-A of FIG. 6(*a*)

Meanwhile, as shown in FIG. 6, the absorption panels 12 may include a rubber pad plate 124 filled with sand 124*a* and compressed wool 124*c* at the front and rear thereof, respectively. In this case, the rubber pad plate 124 is configured by surrounding the outsides of the sand and the wool formed into the shape of a plate in a compressed state with a rubber pad 124*b*. As previously described, the compressed wool decreases rotational force of an empty shell, and speed of the empty shell is greatly lowered while the empty shell passes through the sand. The mount of some of the sand broken due to impact caused by contact between the empty shell and sand and discharged to the outside is minimized by the rubber pad 124*b* surrounding the rear of the sand. Also, the upper end of the rubber pad 124*b* is open so as to fill the amount of the sand partially lost due to penetration of the empty shell through the sand.

In addition, after shots are fired, the rubber pad plate 124 may be separated, and silicon made of the same material as the rubber pad 124*b* may be poured into holes formed at the rubber pad 124*b* as the result of penetration of empty shells. When the rubber pad plate 124 no longer functions as the result of penetration of a large number of empty shells through the rubber pad plate 124, the rubber pad plate 124 may be replaced by a new rubber pad plate.

The interior of the rubber pad plate 124 may be filled with the compressed sand alone. Alternatively, the interior of the rubber pad plate 124 may be filled with another material that is capable of rapidly decreasing kinetic energy of an empty shell. In particular, the material to rapidly decrease kinetic energy of the empty shell is preferably an environmentally friendly material to prevent environmental pollution upon disposal thereof.

Meanwhile, the absorption panels 12, inserted into the sliding grooves, may include one selected from a group consisting of the rubber plate, the compressed wool plate and the rubber pad plate. Preferably, the absorption panels 12 include a rubber plate disposed at the forefront thereof and a rubber plate, a compressed wool plate or a rubber pad plate which may be disposed therein in a mixed state.

Preferably, the rubber pad is disposed at the foremost one of the absorption panels to reduce kinetic energy of an empty shell, the compressed wool plate is disposed next to the rubber pad to absorb rotational force of the empty shell, and the rubber pad plate is disposed next to the compressed wool plate so that the empty shell pierces the rubber pad plate.

Also, the escape prevention panel 13 to prevent an empty shell, having pierced the absorption panels 12, from piercing the escape prevention panel 13 and thus escaping from the empty shell recovery device 100 is disposed at the rearmost one of the sliding grooves.

The escape prevention panel 13 is made of a harder material than the absorption panels 12 to prevent an empty shell, having pierced the absorption panels 12 with the result that kinetic energy of the empty shell is lowered, from piercing the escape prevention panel 13. For example, the escape prevention panel 13 may be made of Fibertex formed by stacking several sheets of synthetic fiber cloth containing fiberglass. The fiberglass used in the Fibertex may be aramid fiber, which is widely used to manufacture, for example, a shellproof vest. Alternatively, the escape prevention panel 13 may be made of a widely used shellproof material, such as a thick steel plate. In this case, the shellproof material is preferably an environmentally friendly material.

Meanwhile, the absorption panels 12, inserted into the respective sliding grooves 111, may include elastic unit panels 12*a*, 12*b* and 12*c* which are stacked in vertical direction. For example, as shown in FIG. 1, three elastic unit panels 12*a*, 12*b* and 12*c* are stacked to constitute one of the absorption panels 12.

In this case, shells fired from a gun aimed at a target board concentrate on the elastic unit panel 12*b* inserted into the middle part of each sliding groove 111. After a predetermined number of shots are fired, therefore, the elastic unit panel 12*b* inserted into the middle part of each sliding groove 111 may be replaced by the elastic unit panel 12*a* or 12*c* inserted into the upper or lower part of each sliding groove 111 to delay the replacement of the absorption panels 12. That is, the position of the upper, middle and lower elastic unit panels may be changed so that the absorption panels can be used several times, thereby lowering operating cost of the empty shell recovery device.

On the other hand, the empty shell discharge unit 2 includes a hopper 21 disposed below the empty shell collection unit 1 so that empty shells, kinetic energy of which has been absorbed by the empty shell collection unit 1, fall downward into and are collected in the hopper 21 and an empty shell receipt box 22 disposed below an outlet port 211 of the hopper 21 so that the empty shells are received in the empty shell receipt box 22.

That is, the hopper 21, which collects the empty shells falling downward from the empty shell collection unit 1, by which kinetic energy of the empty shells has been absorbed, is provided in the main body C, and the empty shell receipt box 22 is provided below the hopper 21, so that the empty shell receipt box 22 can be drawn in the rearward direction, to receive the empty shells collected by the hopper 21.

Figure 3:
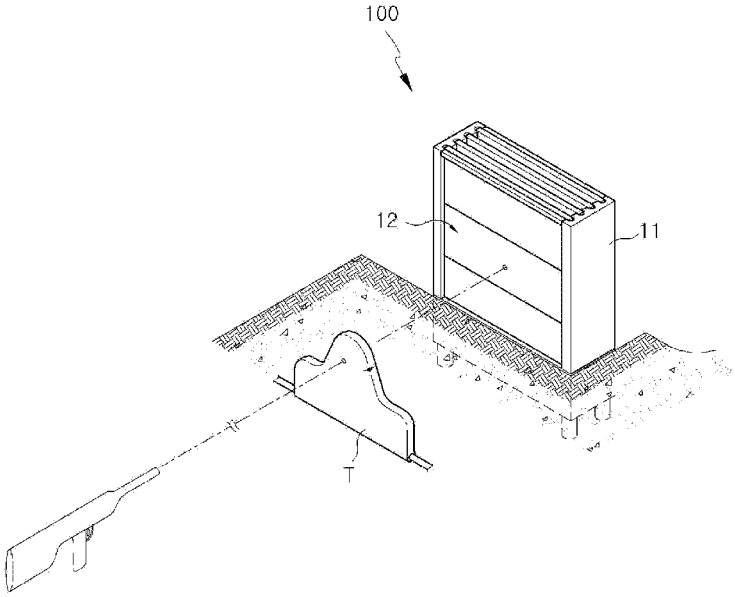
FIG. 3 is a schematic perspective view illustrating a use state of the empty shell recovery device shown in FIG. 1.

Preferably, as shown in FIG. 3, the empty shell recovery device 100 is installed, so that only the empty shell collection unit 1 protrudes from the ground and the empty shell discharge unit 2 is disposed under the ground, to prevent the empty shell discharge unit 2 from being destroyed. Also, the empty shell receipt box 22 may be drawn from the rear of the main body, and therefore, it is possible to easily draw the empty shell receipt box 22 without moving the empty shell recovery device.

Hereinafter, the operation of the empty shell recovery device according to the first embodiment of the present invention will be described with reference to FIGS. 3 and 4.

When a target T is fired upon from a long range during the daytime, i.e. a real-distance shooting, the target T is folded rearward to indicate that the target T has been hit.

The empty shell recovery device 100 according to the first embodiment of the present invention is installed at the rear of the target T to collect empty shells having pierced the target T. At this time, the empty shell recovery device 100 is installed at a position distant from the target T by the height of the target T so that the target T can be smoothly folded.

Figure 4:
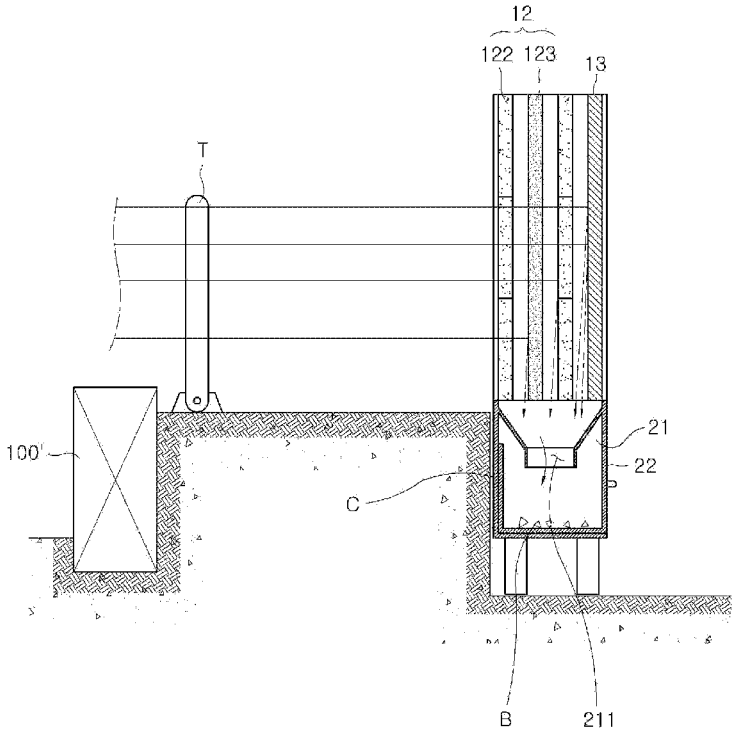
FIG. 4 is a schematic side sectional view illustrating another use state of the empty shell recovery device shown in FIG. 1.

FIG. 4 is a schematic side sectional view illustrating another use state of the empty shell recovery device according to the first embodiment of the present invention.

The thickness of the absorption panels 12 and the number of the absorption panels 12 are adjusted based on the type of a shell used and the shooting distance. That is, when the power of the shell is large or the shooting distance is short, the number of the absorption panels 12 is increased and thick absorption panels 12 are selected. The absorption panels 12 are mounted in the respective sliding grooves.

At this time, each of the absorption panels 12 includes elastic unit panels 12*a*, 12*b* and 12*c* which are stacked. Also, the escape prevention panel 13 is inserted into the rearmost one of the sliding grooves.

When a predetermined number of shots are fired, shells B fired from a gun pierce a target paper 14 and then sequentially pierce the absorption panels 12 from the foremost one of the absorption panels 12 to the rearmost one of the absorption panels 12 in order. Whenever the empty shells pierce the respective absorption panels 12, kinetic energy of the empty shells in the flight direction thereof is sequentially reduced by the respective absorption panels 12. When the empty shells reach the rearmost one of the absorption panels 12 located at the rear of the empty shell collection unit, the kinetic energy of the empty shells become almost extinct. As a result, some of the empty shells come into contact with the rearmost one of the absorption panels 12 and then fall downward, and the remaining empty shells come into contact with the escape prevention panel 13 and then fall downward.

The empty shells B falling downward while having no kinetic energy are collected by the hopper 21 and are received in the empty shell receipt box 22. After shots are fired, the empty shell receipt box 22 is drawn from the main body C to discharge the empty shells B.

Meanwhile, the elastic unit panel located at the middle part of each of the absorption panels 12 is replaced by the elastic unit panel located at the upper or lower part of each of the absorption panels 12 to uniformly achieve reduction in kinetic energy of the empty shells.

Also, an empty shell recovery device 100' according to an embodiment may be further installed below the target at the front thereof to recover empty shells, thereby further improving a recovery rate of the empty shells.

Figure 5:
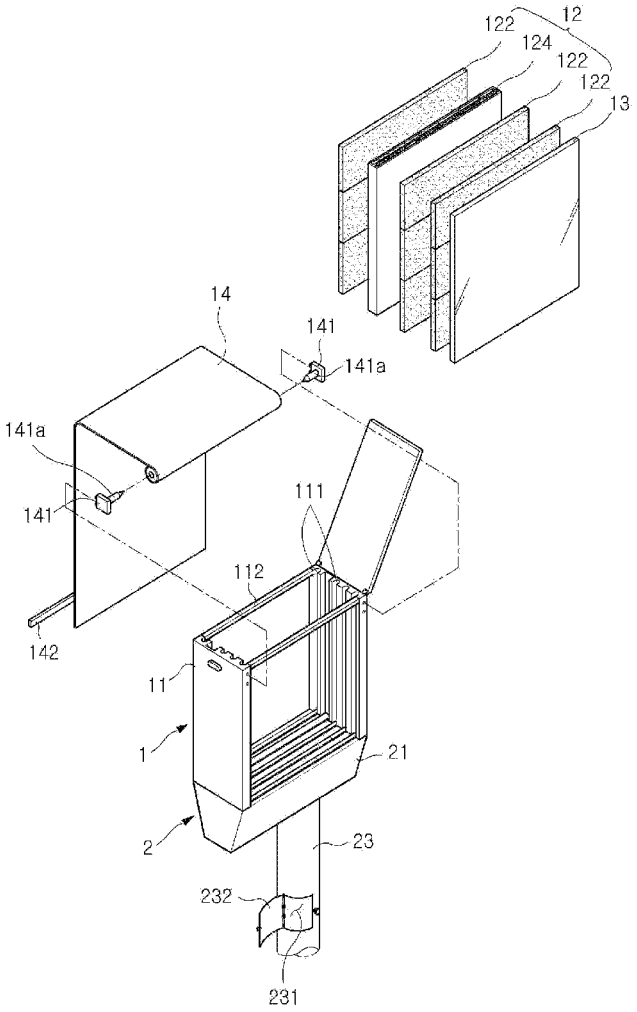
FIG. 5 is a schematic exploded perspective view illustrating an empty shell recovery device according to a second embodiment of the present invention.

FIG. 5 is a schematic exploded perspective view illustrating an empty shell recovery device according to a second embodiment of the present invention.

The empty shell recovery device according to the second embodiment of the present invention includes an empty shell collection unit 1 and an empty shell discharge unit 2. The empty shell collection unit 1 of the empty shell recovery device according to the second embodiment of the present invention is identical in construction, operation and function to the empty shell collection unit of the empty shell recovery device according to the first embodiment of the present invention, and therefore, a description thereof will be omitted.

The empty shell discharge unit 2 includes a hopper 21 coupled to the bottom of the empty shell collection unit 1 and a hollow column 23 disposed below an outlet port 211 formed at the lower end of the hopper 21 so that the hollow column 23 stands on the ground. An exit 231 is formed at the lower part of the column 23, and a door 232 configured to be opened and closed is provided at the exit 231.

In this case, the height of the column may be adjusted to install a target board at the chest height of a shooter in an indoor shooting range. Also, empty shells falling downward from the empty shell collection unit 1 are collected in the column via the hopper 21, and the door 232 is opened to discharge the collected empty shells. Preferably, an inclined plate is further provided in the column at which the exit 231 is formed so that the collected empty shells can be naturally discharged from the column through the exit 231.

Meanwhile, a rolled target paper 14 may be coupled to the upper part of the front of the empty shell collection unit 1. The target paper 14 may be drawn, and the lower end of the target paper 14 may be temporarily fixed to the empty shell discharge unit 2.

The roller target paper 14 is fixed to the upper ends of the rears of opposite side plates 11 by mount holders 141 which are detachably fixed to the upper ends of the rears of the opposite side plates 11. The rolled target paper 14 is drawn to the lower part of the front of the empty shell collection unit 1 via the top of the empty shell collection unit 1 and is temporarily fixed to the front of the main body C.

In this case, each of the mount holders 141 includes a pin 141*a* to fix the center of the rolled target paper. The mount holders 141 may be detachably disposed at the side plates 11 or fixed to the side plates by magnetic force of magnets. Also, the drawn target paper 14 may be temporarily fixed to the front of the main body C by a magnet 142. Alternatively, the target paper 14 may be temporarily fixed to the front of the main body by a pin or a clip.

Since the rolled target paper 14 is coupled to the rear of the empty shell collection unit 1, the mount holders 141 are prevented from being destroyed by empty shells flown from the front. Also, since the target paper is fixed using the mount holders 141 and the magnet 142, it is possible for a user to rapidly replace the target paper by a new one and to rapidly mount the new target paper.

Preferably, the target paper 14 is spaced apart from the outside of the foremost one of the absorption panels 12.

That is, a horizontal bar 112 is coupled to the upper ends of the side plates so that the horizontal bar 112 more forwardly protrudes than the side plates, and the target paper 14 is drawn downward via the top of the horizontal bar 112. Consequently, the target paper 14 is spaced apart from the outside of a corresponding one of the absorption panels 12 inserted into the foremost one of the sliding grooves.

When an empty shell, having pierced the target paper 14, pierces the foremost one of the absorption panels 12, therefore, reaction of the foremost one of the absorption panels 12 caused by impact is not transmitted to the target paper 14 with the result that the target paper 14 is prevented from being damaged due to abrupt deformation of the foremost one of the absorption panels 12. Consequently, it is possible to accurately confirm positions of an impact group during zero-in shooting.

Also, the magnet is removed after one-time shooting, the target paper is removed from the mount holders, and a new target paper is fixed.

Meanwhile, the absorption panels of the empty shell recovery device according to the first or second embodiment of the present invention may have the following construction as an example. The construction of the absorption panels, which will be described hereinafter, is proper to be applied to the empty shell recovery device used for zero-in shooting in which kinetic energy of empty shells is high.

Figure 7:
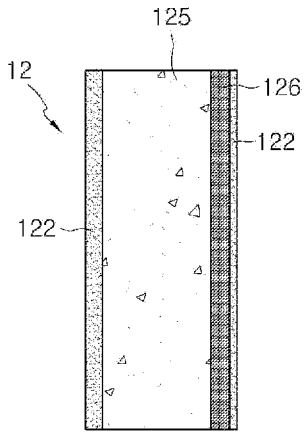
FIG. 7 is a sectional view illustrating a first example of absorption panels according to the present invention.

FIG. 7 is a sectional view illustrating a first example of the absorption panels according to the present invention.

In the first example, the absorption panels 12 may include a rubber plate 122, a sand plate 125, a speed reduction plate 126 and a rubber plate 122 which are arranged in the named order. In this case, the front rubber plate 122 and the rear rubber plate 122 may be formed in the shape of a pouch which is open at the top thereof and closed at the opposite sides and bottom thereof in the same manner as the previously described rubber pad plate.

The sand plate 125 and the speed reduction plate 126 are sequentially disposed between the front rubber plate 122 and the rear rubber plate 122 so that kinetic energy of an empty shell is reduced when the empty shell pierces the sand plate 125 and the speed reduction plate 126. The speed reduction plate 126 is made of a metal material, such as steel, or plastic containing fiberglass to provide increased strength. Consequently, the speed reduction plate 126 greatly reduces linear kinetic energy of an empty shell. The speed reduction plate 126 is made of the same material and exhibits the same function in the following examples of the absorption panels.

The front rubber plate 122 and the rear rubber plate 122 have a thickness of 0.5 cm to 2 cm so that the front rubber plate 122 and the rear rubber plate 122 are not torn due to impact caused by penetration of the empty shell and sand does not leak through a hole formed at the front rubber plate 122 and the rear rubber plate 122 by penetration of the empty shell. That is, the sand plate 125 preferably has a thickness of 7 cm to 10 cm, and the speed reduction plate 126 preferably has a thickness of 2 cm to 3 cm, in consideration of power of a shell fired from a submachine gun using a shell (5.56 mm) or an assault rifle, such as K-2. Kinetic energy of the empty shell, having pierced the absorption panels 12, is sufficiently low with the result that the empty shell collides with the escape prevention panel, falls downward and is collected.

Figure 8:
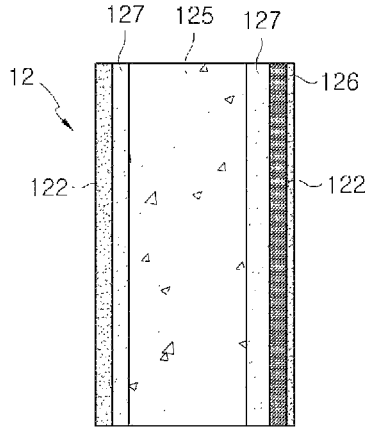
FIG. 8 is a sectional view illustrating a second example of the absorption panels according to the present invention.

FIG. 8 is a sectional view illustrating a second example of the absorption panels according to the present invention.

In the second example, the absorption panels 12 may include a rubber plate 122, a compressed wool plate 127, a sand plate 125, a compressed wool plate 127, a speed reduction plate 126 and a rubber plate 122 which are arranged in the named order. In this case, the absorption panels may be configured in the shape of a pouch open at the top thereof as previously described. The front rubber plate 122 and the rear rubber plate 122 have a thickness of 0.5 cm to 2 cm so that the front rubber plate 122 and the rear rubber plate 122 can fill a hole formed at the front rubber plate 122 and the rear rubber plate 122 by penetration of the empty shell. The sand plate 125 has a thickness of 7 cm to 10 cm so that the sand plate 125 can sufficiently reduce kinetic energy of the empty shell, and the speed reduction plate 126, having a thickness of 2 cm to 3 cm, is disposed at the rear of the sand plate 125.

Also, the compressed wool plates 127 are disposed at the rear of the foremost one of the rubber plates 122 and at the front of the speed reduction plate 126, respectively, to prevent sand from being discharged from the sand plate 125. That is, when a new empty shell passes through the bored portion formed during the previous shooting, a relatively large hole may be formed at the rubber plate 122 or the speed reduction plate 126. The compressed wool plates 127 minimize leakage of sand through the hole. To this end, each of the compressed wool plates 127 preferably has a thickness of approximately 1 cm.

Figure 9:
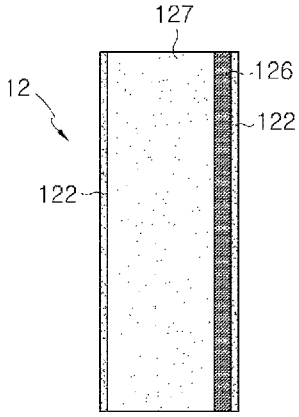
FIG. 9 is a sectional view illustrating a third example of the absorption panels according to the present invention.

FIG. 9 is a sectional view illustrating a third example of the absorption panels according to the present invention.

In the third example, the absorption panels 12 may include a rubber plate 122, a compressed wool plate 127, a speed reduction plate 126 and a rubber plate 122 which are arranged in the named order. In this case, the compressed wool plate 127 may be wetted.

The absorption panels may be configured in the shape of a pouch open at the top thereof as previously described. Also, wet wool of the compressed wool plate 127 is highly cohesive to effectively absorb kinetic energy, particularly rotational kinetic energy, of an empty shell.

Also, each of the rubber plates 122 has a thickness of 0.5 cm to 2 cm to prevent some of the compressed wool from escaping outward due to collision of the empty shell with the compressed wool plate 127. The compressed wool plate 127 has a thickness of 8 to 10 cm, and the speed reduction plate 126 has a thickness of 2 cm to 3 cm so that kinetic energy of a shell fired from the previously described shell can be sufficiently reduced when the empty shell pierces the speed reduction plate 126.

The empty shell, having pierced the absorption panels with the above-stated construction, collides with the escape prevention panel, falls downward and is collected.

Figure 10:
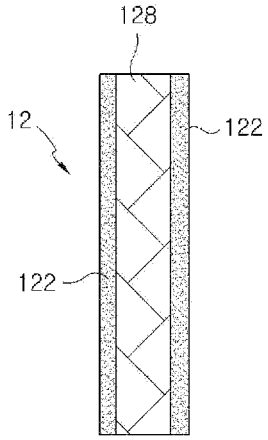
FIG. 10 is a sectional view illustrating a fourth example of the absorption panels according to the present invention.

FIG. 10 is a sectional view illustrating a fourth example of the absorption panels according to the present invention.

In the fourth example, the absorption panels 12 may include a rubber plate 122, a compressed paper plate 128 and a rubber plate 122 which are arranged in the named order. In this case, the absorption panels may be configured in the shape of a pouch open at the top thereof as previously described. Also, the compressed paper plate 128 is configured by stacking and compressing several sheets of thin paper to absorb both rotational kinetic energy and linear kinetic energy of an empty shell when the empty shell pierces the compressed paper plate 128.

The front rubber plate 122 and the rear rubber plate 122 prevent paper pieces, separated from the compressed paper plate 128 due to impact caused by the empty shell, from being discharged to the outside. Each of the rubber plates 122 has a thickness of 0.5 cm to 2 cm with the result that each of the rubber plates 122 is prevented from being ruptured by the empty shell. The compressed paper plate 128 may have a thickness of 2 to 5 cm.

Figure 11:
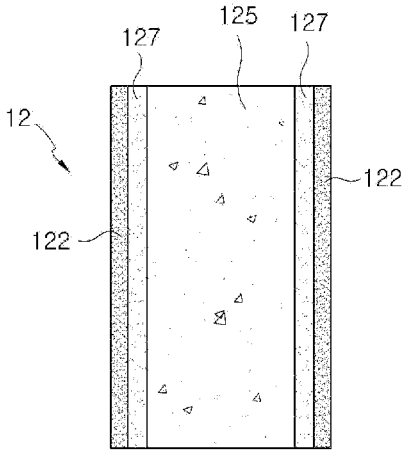
FIG. 11 is a sectional view illustrating a fifth example of the absorption panels according to the present invention.

FIG. 11 is a sectional view illustrating a fifth example of the absorption panels according to the present invention.

In the fifth example, the absorption panels 12 may include a rubber plate 122, a compressed wool plate 127, a sand plate 125, a compressed wool plate 127 and a rubber plate 122 which are arranged in the named order. The rubber plates 122 and the compressed wool plates 127 attached to the front and rear of the sand plate 125, respectively, minimize leakage of sand through a hole formed by penetration of an empty shell.

Each of the rubber plates 122 has a thickness of 0.5 cm to 2 cm, and the sand plate 125 has a thickness of 12 cm to 15 cm to sufficiently absorb kinetic energy of the empty shell.

Also, a plurality of absorption panels may be arranged one after another to more effectively absorb energy of an empty shell.

In the absorption panels 12, the sand plate 125 may be wetted so that cohesive force between sand particles is further increased to more effectively reduce kinetic energy of an empty shell. Also, the absorption panels 12 may be unitized so that the absorption panels 12 can be easily replaced after several shots are fired. Also, the absorption panels 12 may optionally include a rubber plate, a sand plate, a compressed wool plate, a compressed paper plate or a speed reduction plate in addition to the above construction.

The invention claimed is:

1. An empty shell recovery device comprising:

an empty shell collection unit comprising absorption panels that are isolated from each other and inserted into sliding grooves formed at opposite side plates facing each other to absorb kinetic energy of empty shells, the absorption panels being replaceable, and an escape prevention panel that is inserted into the sliding grooves located at the rear parts of the side plates to prevent the empty shells from escaping; and an empty shell discharge unit to collect and discharge the empty shells falling downward from the empty shell collection unit, wherein the absorption panels comprise a rubber plate, a compressed paper plate and a rubber plate, which are arranged in the named order.

2. The empty shell recovery device according to claim 1, wherein the absorption panels comprise a plurality of elastic unit panels stacked in the sliding grooves.

3. The empty shell recovery device according to claim 1, wherein the escape prevention panel is made of Fibertex.

4. The empty shell recovery device according to claim 1, wherein a rolled target paper is coupled to the upper part of the rear of the empty shell collection unit, and the target paper is drawn so that the lower end of the target paper is temporarily fixed to the empty shell discharge unit via the front of the empty shell collection unit.

5. The empty shell recovery device according to claim 4, wherein the target paper is spaced apart from the outside of the foremost one of the absorption panels.

6. The empty shell recovery device according to claim 1, wherein the empty shell discharge unit comprises a hopper disposed below the empty shell collection unit and an empty shell receipt box disposed below an outlet port of the hopper.

7. The empty shell recovery device according to claim 1, wherein the empty shell discharge unit comprises a hopper disposed below the empty shell collection unit and a column coupled to an outlet port of the hopper below the outlet port of the hopper, the column being provided at the lower part thereof with a door.

8. The empty shell recovery device according to claim 1, wherein each of the rubber plates has a thickness of 0.5 cm to 2 cm, and the compressed paper plate has a thickness of 2 cm to 5 cm.

9. An empty shell recovery device comprising:

an empty shell collection unit comprising absorption panels that are isolated from each other and inserted into sliding grooves formed at opposite side plates facing each other to absorb kinetic energy of empty shells, the absorption panels being replaceable, and an escape prevention panel that is inserted into the sliding grooves located at the rear parts of the side plates to prevent the empty shells from escaping; and an empty shell discharge unit to collect and discharge the empty shells falling downward from the empty shell collection unit, wherein the absorption panels comprise a rubber plate, a sand plate, a speed reduction plate and a rubber plate which are arranged in the named order.

10. The empty shell recovery device according to claim 9, wherein each of the rubber plates has a thickness of 0.5 cm to 2 cm, the sand plate has a thickness of 7 cm to 10 cm, and the speed reduction plate has a thickness of 2 cm to 3 cm.

11. An empty shell recovery device comprising:

an empty shell collection unit comprising absorption panels that are isolated from each other and inserted into sliding grooves formed at opposite side plates facing each other to absorb kinetic energy of empty shells, the absorption panels being replaceable, and an escape prevention panel that is inserted into the sliding grooves located at the rear parts of the side plates to prevent the empty shells from escaping; and an empty shell discharge unit to collect and discharge the empty shells falling downward from the empty shell collection unit, wherein the absorption panels comprise a rubber plate, a compressed wool plate, a sand plate, a compressed wool plate, a speed reduction plate and a rubber plate, which are arranged in the named order.

12. An empty shell recovery device comprising:

an empty shell collection unit comprising absorption panels that are isolated from each other and inserted into sliding grooves formed at opposite side plates facing each other to absorb kinetic energy of empty shells, the absorption panels being replaceable, and an escape prevention panel that is inserted into the sliding grooves located at the rear parts of the side plates to prevent the empty shells from escaping; and an empty shell discharge unit to collect and discharge the empty shells falling downward from the empty shell collection unit, wherein the absorption panels comprise a rubber plate, a compressed wool plate, a speed reduction plate and a rubber plate which are arranged in the named order, the compressed wool plate being wetted.

13. The empty shell recovery device according to claim 12, wherein each of the rubber plates has a thickness of 0.5 cm to 2 cm, the compressed wool plate has a thickness of 8 cm to 10 cm, and the speed reduction plate has a thickness of 2 cm to 3 cm.

14. An empty shell recovery device comprising:

an empty shell collection unit comprising absorption panels that are isolated from each other and inserted into sliding grooves formed at opposite side plates facing each other to absorb kinetic energy of empty shells, the absorption panels being replaceable, and an escape prevention panel that is inserted into the sliding grooves located at the rear parts of the side plates to prevent the empty shells from escaping; and an empty shell discharge unit to collect and discharge the empty shells falling downward from the empty shell collection unit, wherein the absorption panels comprise a rubber plate, a compressed wool plate, a sand plate, a compressed wool plate and a rubber plate which are arranged in the named order.

* * * * *